US011307001B2

(12) United States Patent
Lynch et al.

(10) Patent No.: US 11,307,001 B2
(45) Date of Patent: Apr. 19, 2022

(54) AERIAL DEVICES HAVING BALLISTIC PROTECTION

(71) Applicant: Ameren Corporation, St. Louis, MO (US)

(72) Inventors: Benjamin N. Lynch, Columbia, IL (US); Steve Schmitz, St. Louis, MO (US); Steve Hampton, St. Louis, MO (US)

(73) Assignee: Ameren Corporation, St. Louis, MO (US)

( * ) Notice: Subject to any disclaimer, the term of this patent is extended or adjusted under 35 U.S.C. 154(b) by 45 days.

(21) Appl. No.: 16/539,789

(22) Filed: Aug. 13, 2019

(65) Prior Publication Data

US 2021/0048277 A1 Feb. 18, 2021

(51) Int. Cl.

| | |
|---|---|
| ***F41H 5/013*** | (2006.01) |
| ***F41H 5/04*** | (2006.01) |
| ***B66F 17/00*** | (2006.01) |

(52) U.S. Cl.

CPC ..... *F41H 5/013* (2013.01); *B66F 17/006* (2013.01); *F41H 5/0485* (2013.01)

(58) Field of Classification Search

CPC ..... F41H 5/013; F41H 5/0485

USPC ..... 89/36.02

See application file for complete search history.

(56) References Cited

U.S. PATENT DOCUMENTS

| | | | | |
|---|---|---|---|---|
| 5,663,520 | A * | 9/1997 | Ladika | F41H 5/226 296/187.07 |
| 8,109,557 | B1 * | 2/2012 | Salinas | F41H 7/042 296/97.23 |
| 2009/0120273 | A1 * | 5/2009 | Eckdahl | F41H 13/00 89/36.08 |
| 2013/0319792 | A1 * | 12/2013 | Christian | B66F 11/044 182/2.2 |
| 2014/0082844 | A1 * | 3/2014 | Bertsch | F41H 5/08 5/627 |
| 2014/0083285 | A1 * | 3/2014 | Marissen | F41H 5/04 89/36.02 |
| 2014/0202324 | A1 * | 7/2014 | Robbins | B62D 55/06 89/36.08 |
| 2014/0311329 | A1 * | 10/2014 | Dyke | F41H 5/0428 89/36.02 |
| 2014/0326841 | A1 * | 11/2014 | Goodheart | B66F 11/04 248/201 |
| 2015/0027808 | A1 * | 1/2015 | Baillargeon | A62B 35/0025 182/3 |
| 2016/0178328 | A1 * | 6/2016 | Citterio | F41H 5/0485 89/36.02 |

(Continued)

*Primary Examiner* — Joshua E Freeman

(74) *Attorney, Agent, or Firm* — Lewis Rice LLC

(57) ABSTRACT

An aerial lift system is provided for ballistic protection. The system includes an aerial lift device comprising a floor and a sidewall, the floor and the sidewall defining an interior cavity adapted for supporting one or more persons therein; and a liner comprising a floor and a sidewall and being adapted to be positioned within the interior cavity of the aerial lift device, and defining an opening between the aerial lift device and the liner. Additionally, the system includes at least one of the following: the system further includes a ballistic material adapted to be positioned between the liner and the aerial lift device; or the aerial lift device is comprised of a ballistic material; or the liner is comprised of a ballistic material.

20 Claims, 5 Drawing Sheets

(56) References Cited

U.S. PATENT DOCUMENTS

| | | | | |
|---|---|---|---|---|
| 2016/0187107 | A1* | 6/2016 | Johnston | F41H 7/00 89/36.08 |
| 2016/0368738 | A1* | 12/2016 | Minke | B66F 11/04 |
| 2017/0355579 | A1* | 12/2017 | McKinney | E06C 9/02 |
| 2019/0112172 | A1* | 4/2019 | Wabnegger | B08B 9/00 |
| 2019/0135603 | A1* | 5/2019 | Bilic | H02G 1/02 |
| 2019/0210852 | A1* | 7/2019 | Fritel | B66F 11/046 |
| 2019/0233270 | A1* | 8/2019 | Dittus | B66F 17/006 |
| 2019/0271438 | A1* | 9/2019 | McKinney | F16M 13/02 |
| 2020/0095727 | A1* | 3/2020 | Campbell | F16G 11/025 |
| 2020/0102762 | A1* | 4/2020 | Donaldson | B66F 11/044 |
| 2020/0189892 | A1* | 6/2020 | Huddleston | E06C 9/10 |
| 2020/0207600 | A1* | 7/2020 | Bonnefoy | B66F 17/006 |
| 2020/0346909 | A1* | 11/2020 | McKinney | B66F 11/044 |

* cited by examiner

AERIAL DEVICES HAVING BALLISTIC PROTECTION

CROSS REFERENCE TO RELATED APPLICATIONS

Not applicable.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

REFERENCE TO A SEQUENCE LISTING, TABLE, OR COMPUTER PROGRAM LISTING APPENDIX SUBMITTED ON A COMPACT DISC AND AN INCORPORATION-BY-REFERENCE OF THE MATERIAL ON A COMPACT DISC

Not applicable.

FIELD OF THE INVENTION

The invention relates to aerial lift systems. More particularly, the invention relates to aerial lift systems for providing ballistic protection.

BACKGROUND OF THE INVENTION

Aerial lift devices are used to provide field workers with access to electrical power lines, trees, and upper stories of buildings in construction or during fires or other emergencies. Conventional aerial lift devices are generally made from electrically insulative materials, but do not provide any protection if a field worker encounters a situation where a firearm is discharged in his direction. A need exists to ensure worker safety against the use of firearms when the worker is using an aerial lift device.

BRIEF SUMMARY OF THE INVENTION

An aerial lift system providing ballistic protection is provided. The system includes an aerial lift device and a liner. The aerial lift device comprises a floor and a sidewall. The floor and the sidewall define an interior cavity adapted for supporting one or more persons therein. The liner comprises a floor and a sidewall. The liner is adapted to be positioned within the interior cavity of the aerial lift device. The liner also optionally defines an opening between the aerial lift device and the liner. Additionally, the system includes at least one of the following: the system further comprises a ballistic material adapted to be positioned in the opening between the aerial lift device and the liner; or the aerial lift device is comprised of a ballistic material; or the liner is comprised of a ballistic material.

Other objects and features will be in part apparent and in part pointed out hereinafter.

BRIEF DESCRIPTION OF THE SEVERAL VIEWS OF THE DRAWING

Corresponding reference characters indicate corresponding parts throughout the drawings.

DETAILED DESCRIPTION OF THE INVENTION

Figure 1:
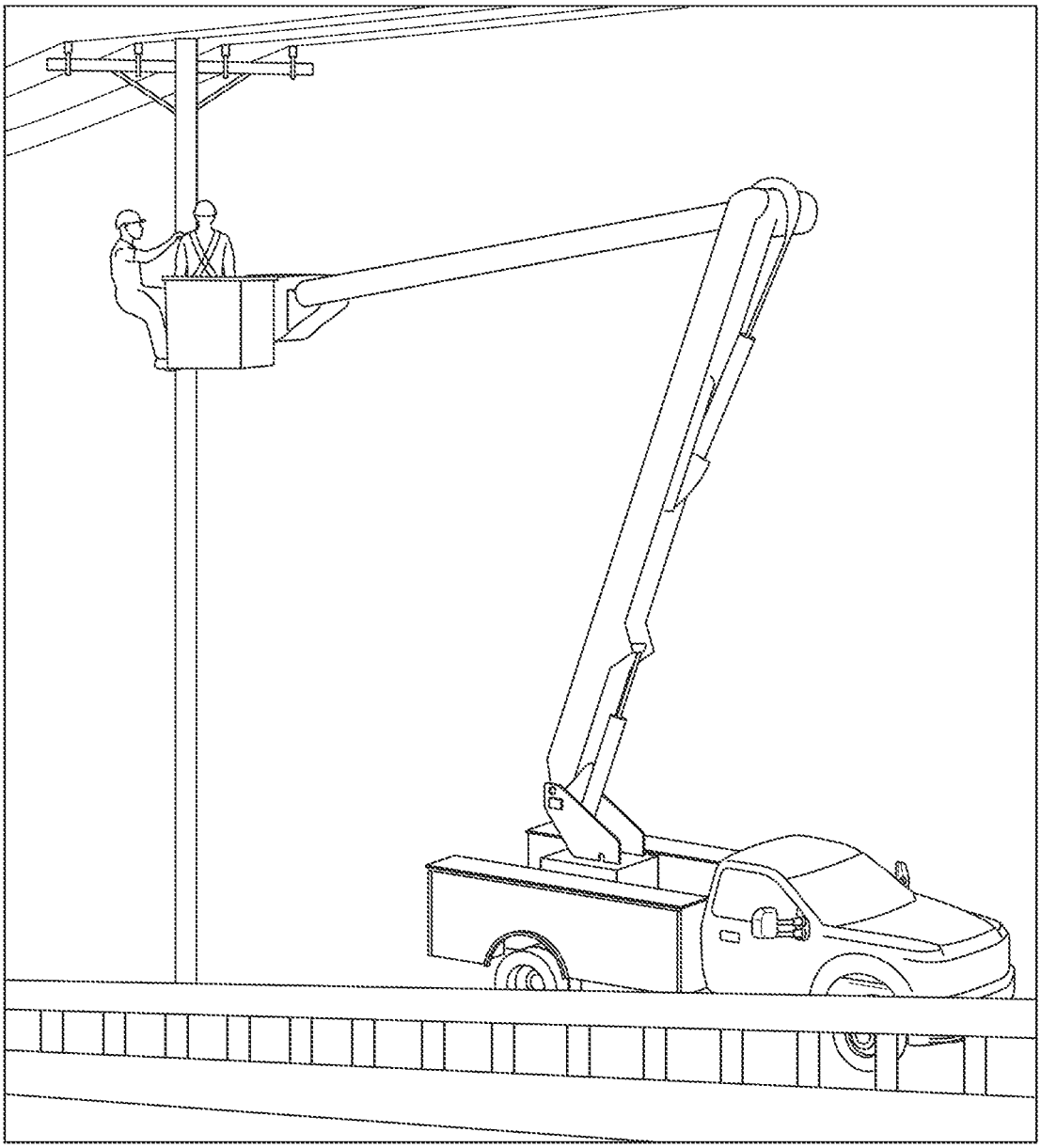
FIG. 1 is a photograph of an aerial lift system of the invention suspended from a boom on an aerial lift truck.

It has been discovered that an aerial lift device can be developed to provide ballistic protection against firearm threats without exceeding weight limitations for such devices. The aerial lift systems have been used in the field for extended periods of time without showing signs of stress cracking or other damage and without developing moisture damage or mold growth. FIG. 1 is a photograph showing such an aerial lift system in use. The aerial lift system is attached to a boom of an aerial lift vehicle. The aerial lift system of the invention can be used with any aerial lift vehicle that includes an aerial lift device.

Figure 2:
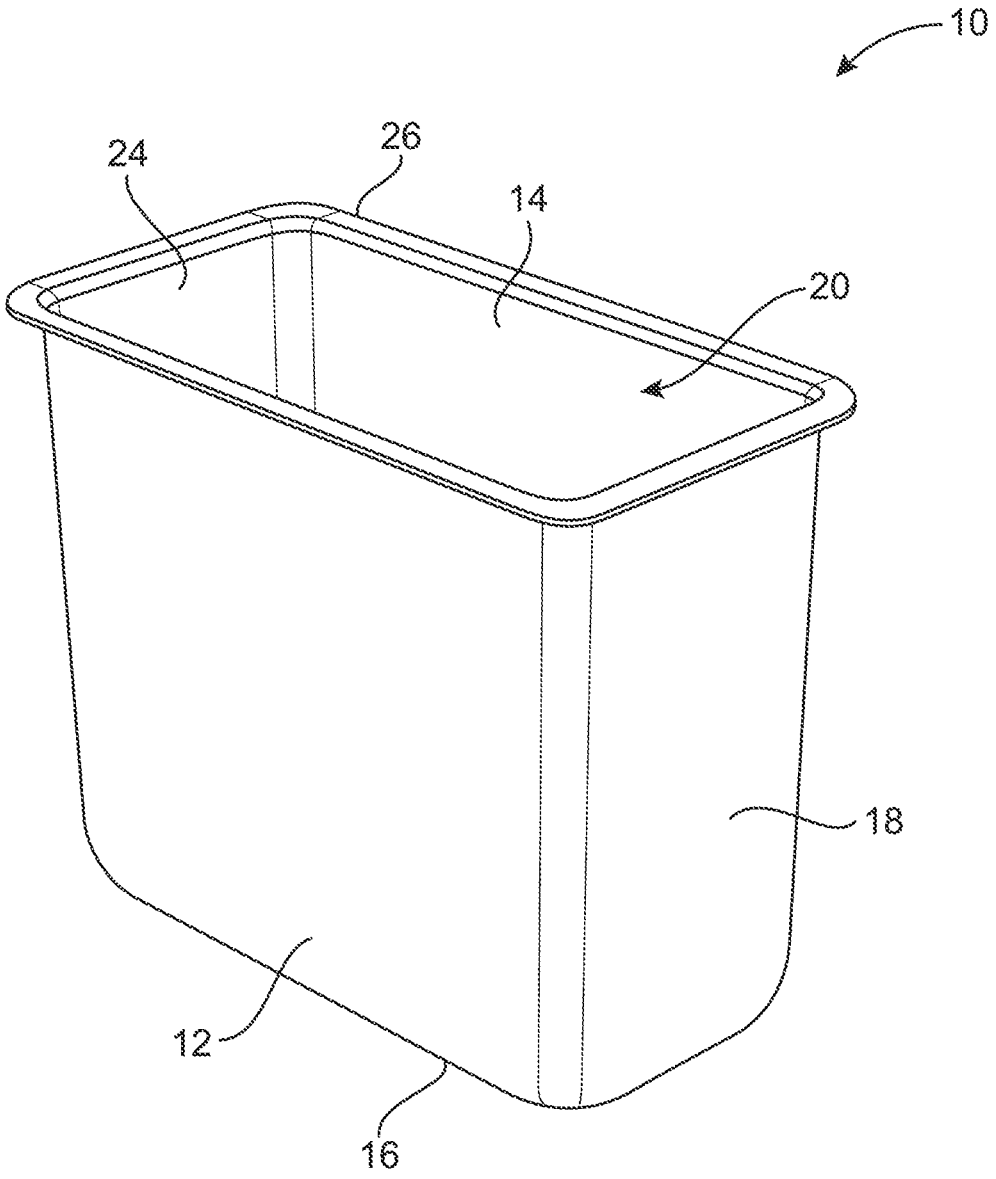
FIG. 2 depicts an aerial lift system of the invention.

One aspect of the invention is shown in FIG. 2 and is directed to an aerial lift system 10 providing ballistic protection. The system 10 includes an aerial lift device 12 and a liner 14. The aerial lift device comprises a floor 16 and one or more sidewalls 18. The floor 16 and the sidewalls 18 define an interior cavity 20 adapted for supporting one or more persons therein. The liner 14 comprises a floor 22 and one or more sidewalls 24. The liner 14 is adapted to be positioned within the interior cavity 20 of the aerial lift device 12. The liner 14 also optionally defines an opening (not shown) between the aerial lift device 12 and the liner 14. Additionally, the system includes at least one of the following: the system further comprises a ballistic material (not shown) adapted to be positioned in the opening between the aerial lift device 12 and the liner 14; or the aerial lift device 12 is comprised of a ballistic material; or the liner 14 is comprised of a ballistic material.

The liner 14 can include a rim 26 along the top of the sidewall 24 of the liner, the rim 26 being adapted to extend toward the aerial lift device 12 to cover the opening 28 between the aerial lift device 12 and the liner 14.

Preferably, the ballistic material is not visible from the exterior of the aerial lift device so as not to alert the public to the enhanced safety protection provided by the aerial lift system.

Figure 3:
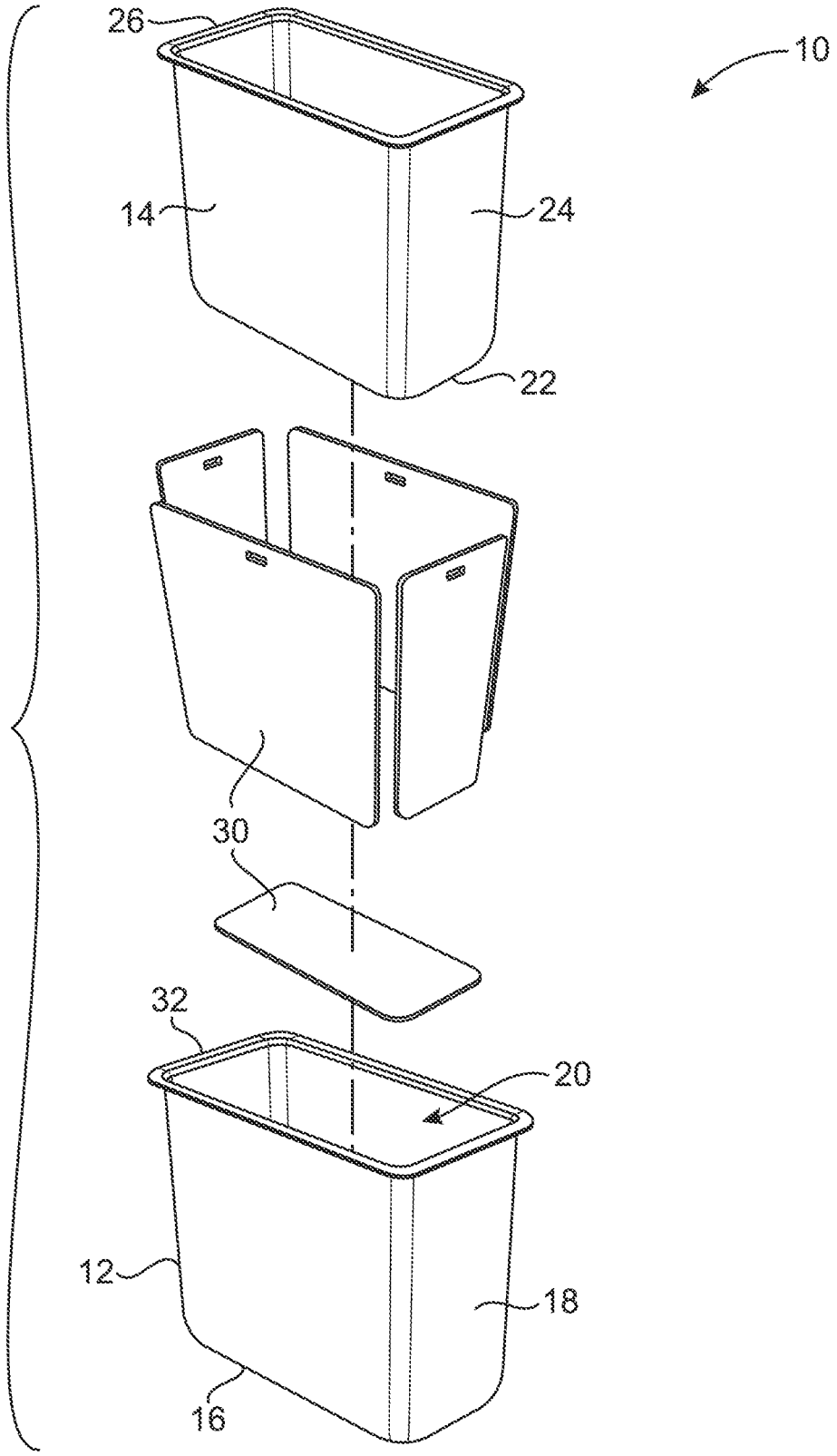
FIG. 3 is an expanded view of an aerial lift system including a bucket, panels of ballistic material and a liner.
Figure 4:
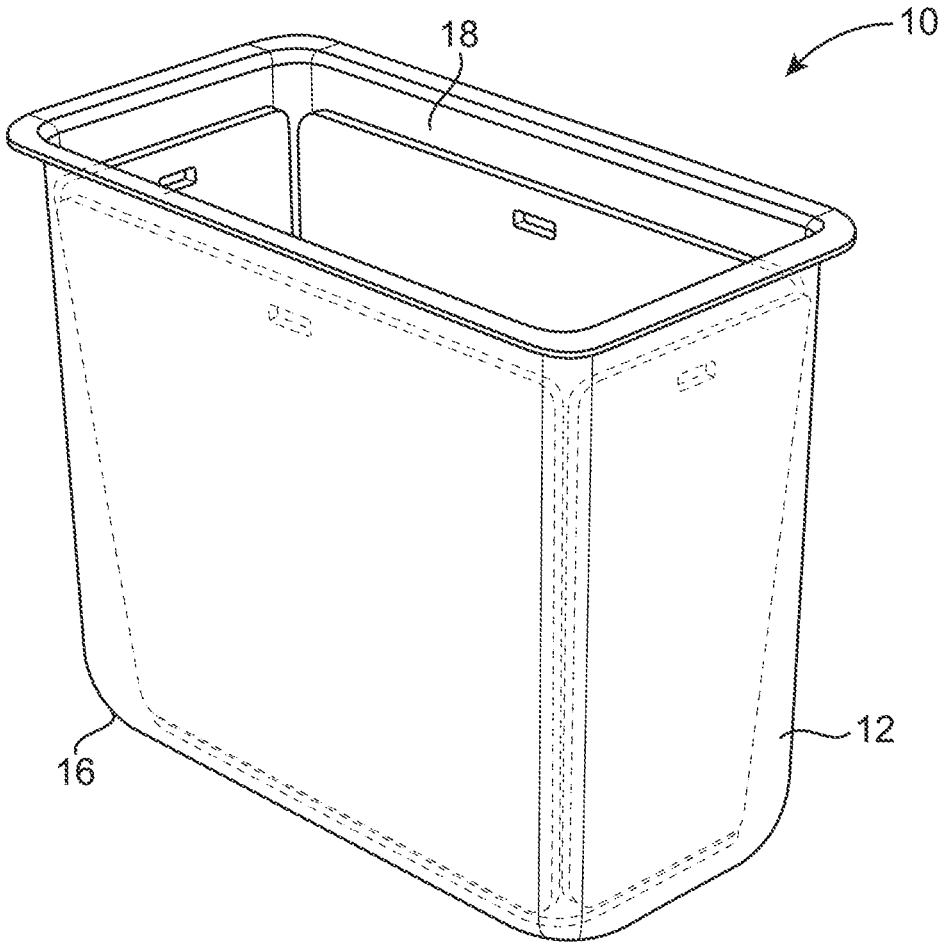
FIG. 4 depicts an aerial lift system including panels of ballistic material prior to installation of a liner.
Figure 5:
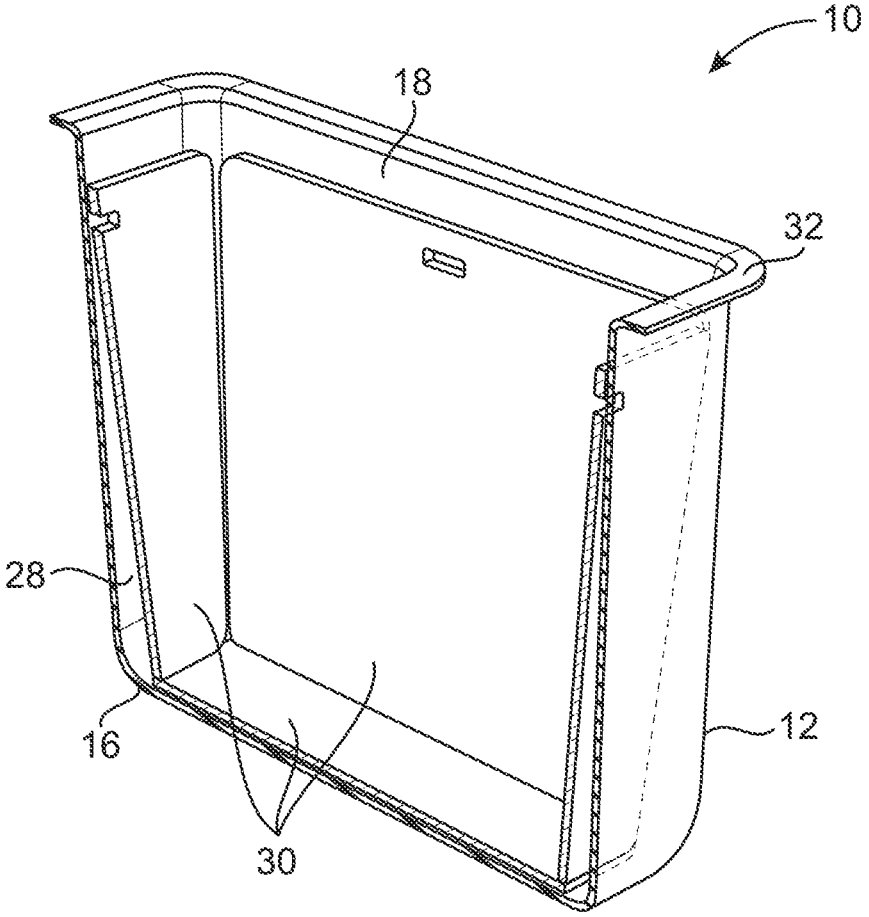
FIG. 5 depicts a cross-sectional view of the aerial lift system of FIG. 4.

FIGS. 3, 4 and 5 show an aerial lift system 10 in which a ballistic material 30 is positioned in the opening 28 between the device 12 and the liner 14. The ballistic material 30 can be positioned between the sidewalls 18 of the device 12 and the sidewalls 24 of the liner 14, and/or between the floor 16 of the device 12 and the floor 22 of the liner 14. The device 12 can have a rim 32, and the rim 26 of the liner 14 can extend onto or over the rim 32 to seal the opening 28 against moisture when the liner 14 is installed over the ballistic material 30.

When the system further comprises a ballistic material adapted to be positioned in the opening between the aerial lift device 12 and the liner 14 as shown in FIGS. 4 and 5, the ballistic material 30 can be adapted to retrofit an existing aerial lift device 12 and liner 14. Although not required for all embodiments, retrofitting an existing aerial lift device 12 ensures that the exterior appearance of the aerial lift device remains unchanged and conventional to avoid alerting the public to whether or not an aerial lift device includes the enhanced safety protection provided by the aerial lift system. Also, retrofitting the existing aerial lift devices and liners is far more cost effective than replacing an existing fleet of aerial lift devices. Conventional aerial lift devices and liners are commercially available from various manufacturers including Altec Inc., of Birmingham, Ala. Any aerial lift device and liner can be retrofitted in accordance with the invention.

When the aerial lift device 12 as shown in FIG. 2 is comprised of a ballistic material, there need not be an opening between the device 12 and the liner 14, and the liner 14 need not comprise ballistic material. It is advantageous to construct a device 12 comprising ballistic material to reduce the overall weight of the system 10 as compared to a system 10 wherein the ballistic material is positioned in the opening between the device 12 and the liner 14.

When the liner 14 as shown in FIG. 2 is comprised of a ballistic material, there need not be an opening between the device 12 and the liner 14 and the device 12 need not comprise ballistic material. It is advantageous to construct a liner comprising ballistic material to reduce the overall weight of the system 10 as compared to a system 10 wherein the ballistic material is positioned in the opening between the device 12 and the liner 14. Also, the exterior appearance of the aerial lift device remains unchanged and conventional to avoid alerting the public to whether or not an aerial lift device includes the enhanced safety protection provided by the aerial lift system.

Preferably, the weight of the ballistic material is minimized while maintaining a reasonable level of safety. If the ballistic material adds too much weight to the aerial lift system, the aerial lift device, or components of the vehicle to which the system is attached, could experience stress cracks or other evidence of stress or overuse.

The ballistic materials are commercially available in various weights and thicknesses to provide protection against a range of threats ranging from handguns to rifles. For example, ballistic materials are rated by the National Institute of Justice (NIJ) which sets voluntary standards for body armor. NIJ Standard-0101.06 specifies five levels of ballistic performance for body armor. The first three levels—IIA, II and IIIA—are typically soft armors. The two remaining levels, III and IV, are typically hard armor designed to protect officers against rifle threats. The standard threat ammunition associated with these five levels are listed below:

Type IIA. 9 mm full metal jacket (FMJ) round nose (RN); .40 Smith and Wesson (S&W) FMJ.

Type II. 9 mm FMJ RN; .357 Magnum jacketed soft point (JSP).

Type IIIA. .357 Sig Sauer FMJ flat nose (FN); .44 Magnum SJHP.

Type III. 7.62 mm FMJ (M80) (Rifle).

Type IV. .30 Cal armor piercing (AP) (M2 AP) (Rifle).

Preferably, the ballistic material selected has an NIJ type IIIA level of protection to protect against most handguns that might be encountered in the field. Although it is desirable to provide a level of protection against rifles and armor piercing ammunition, the additional weight required to provide such protection could put stresses on the boom, aerial lift device and vehicle that could lead to stress cracks or other degradation.

It is desirable to select a ballistic material having the greatest specific strength (i.e., tensile strength to weight ratio) while still providing at least an NIJ type IIIA level of protection. The ballistic material can have a tensile strength to weight ratio of at least 2000, 2500, 3000, or 3500 kN·m/kg, and can range, for example, from about 2000 to about 4000 kN·m/kg or more, from about 2500 to about 4000 kN·m/kg or from about 3000 to about 4000 kN·m/kg. For example, the ballistic material can comprise ultra-high molecular weight polyethylene (e.g., DYNEEMA™ armor panel from DSM which can provide specific strength as great as 3711 kN·m/kg, or SPECTRA™ from Honeywell), an aromatic polyamide also known as an aramid (e.g., KEVLAR™ from Dow Chemical Co. which can provide specific strength as great as 2514 kN·m/kg, TWARON™ from Teijin, or GOLD FLEX™ or GOLD SHIELD™ from Honeywell), an aromatic polyester (e.g., VECTRAN from Kuraray Co., Ltd. which can provide specific strength as great as 2071 kN·m/kg), a thermoset liquid-crystalline polyoxazole such as poly(p-phenylene-2,6-benzobisoxazole (e.g., ZYLON™ from Toyobo Corp. which can provide specific strength as great as 3766 kN·m/kg), high modulus polypropylene, or nylon. Preferably, the ballistic material comprises ultra-high molecular weight polyethylene.

The ballistic material can be a woven, a nonwoven, a cross-ply, or a composite material.

The ballistic material can comprise a composite made from unidirectional fibers positioned between layers of resin, such as a DYNEEMA™ armor panel. If the ballistic material is a DYNEEMA™ armor panel, for example, an NIJ IIIA level of protection is provided when such ballistic material is 7/32 in. (5.6 mm) thick and weighs 1 lb/ft$^2$ (about 5 kg/m$^2$).

Alternatively, the ballistic material can comprise a woven fabric such as KEVLAR™.

The ballistic material can have a mass per unit area of less than 20, 15, 10 kg/m$^2$, or 5 kg/m$^2$. For example, the mass per unit area can be from about 5 kg/m$^2$ to about 10 kg/m$^2$ for an aerial lift system. It is desirable to select a ballistic material having the least mass per unit area while still providing at least an NIJ type IIIA level of protection.

The ballistic material can have a thickness of from about 4 to about 40 mm, from about 5 to about 25 mm, from about 5 to about 20 mm, or from about 5 to about 10 mm. It is desirable to select a ballistic material having the least thickness while still providing at least an NIJ type IIIA level of protection.

Preferably, the ballistic material can comprise a water-resistant gel coating on its exterior surface to provide protection against moisture or mold.

Any aerial lift device can be retrofitted to include a ballistic material between the device and the liner. Such lift devices are commonly used when repairing electrical power lines, in tree care, and in construction.

The aerial lift device can comprise a work platform such as a bucket or a basket.

The work platform can be adapted for being secured to an electric or hydraulic lift system of a lift vehicle. For example, the work platform can be mounted to a boom.

Preferably, the aerial lift device, the liner and the ballistic material are comprised of an electrical insulator.

Having described the invention in detail, it will be apparent that modifications and variations are possible without departing from the scope of the invention defined in the appended claims.

EXAMPLES

The following non-limiting examples are provided to further illustrate the present invention.

Example 1

Conventional aerial buckets (commercially available from Altec Inc. of Birmingham, Ala.) were tested by shooting live ammunition from various distances. Every caliber of ammunition that was fired penetrated the aerial bucket and either fragmented into the adjacent wall or penetrated the opposite side, offering no ballistic protection as shown in Table 1.

TABLE 1

| Test | Ballistic Protection | Handgun or Rifle fired (Distance in feet) | Bullet Size | Did the bullet penetrate bucket and liner? | Did the bullet penetrate an adjacent wall or the opposite wall? |
|---|---|---|---|---|---|
| 1 | No | .308 (15) | 168 grain SMK | Yes | Yes |
| 2 | No | SKS (15) | 123 grain FMJ | Yes | Yes |
| 3 | No | AR15 .223 (15) | 55 grain FMJ | Yes | Yes |
| 4 | No | 12 gauge Slug(15) | 2¾" | Yes | Yes |
| 5 | No | 12 gauge (15) | OOS | Yes | 1 of 9 penetrated, but other fragments |
| 6 | No | .380 (10) | 90 grain FMJ | Yes | No |
| 7 | No | 9 mm (10) | 147 grain FMJ | Yes | Yes |
| 8 | No | 38 Special (10) | 158 grain hollow | Yes | No |
| 9 | No | 357 Mag (10) | 158 grain SWC* | Yes | Yes |
| 10 | No | .40 (10) | 180 grain Hollow | Yes | Yes |
| 11 | No | .45 (10) | 230 grain FMJ | Yes | Yes |

Example 2

The same aerial buckets as tested in Example 1 were then retrofitted with DYNEEMA™ panels between the aerial bucket and the liner. The DYNEEMA™ panels were 7/32 in. (5.6 mm) thick and weighed 1 lb/ft$^2$ (about 5 kg/m$^2$) to provide NIJ level IIIA protection. The liner was removed so that the panels could be placed against the bucket. The liner was then reinstalled over the panels to cover and enclose the panels. The panels added about 71 pounds of weight to the aerial lift device. If only a bottom panel was installed, about 9 pounds of weight was added to the aerial lift device. As shown in Table 2, handgun ammunition fired at a distance of 10 to 15 feet did not penetrate the bucket and liner.

TABLE 2

| Test | Ballistic Protection | Handgun or Rifle fired (Distance in feet) | Bullet Size | Did the bullet penetrate bucket and liner? | Did the bullet penetrate an adjacent wall or the opposite wall? |
|---|---|---|---|---|---|
| 12 | Yes | .308 (15) | 168 grain SMK | Yes | Yes |
| 13 | Yes | SKS (15) | 123 grain FMJ | Yes | Yes |
| 14 | Yes | AR15 .223 (15) | 55 grain FMJ | Yes | Yes |
| 15 | Yes | 12 gauge Slug(15) | 2¾" | No | No |
| 16 | Yes | 12 gauge (15) | OOS | No | No |
| 17 | Yes | .380 (10) | 90 grain FMJ | No | No |
| 18 | Yes | 9 mm (10) | 147 grain FMJ | No | No |
| 19 | Yes | 38 Special (10) | 158 grain hollow | No | No |
| 20 | Yes | 357 Mag (10) | 158 grain SWC* | No | No |
| 21 | Yes | .40 (10) | 180 grain Hollow | No | No |
| 22 | Yes | .45 (10) | 230 grain FMJ | No | No |

Example 3

The same aerial buckets as tested in Example 1 were then retrofitted with NIJ level III+ protection. The liner was removed so that the panels could be placed against the bucket. The liner was then reinstalled over the panels to cover and enclose the panels. The panels added about 278 pounds of weight to the aerial lift device. If only a bottom panel was installed, about 35 pounds of weight was added to the aerial lift device. As shown in Table 3, rifle ammunition fired at a distance of 15 feet did not penetrate the bucket and liner. However, there was a 350 pound weight limitation for the aerial buckets to be used in service, and the NIJ level III+ protection was too heavy to meet these limitations once the weight of the aerial bucket, liner, worker and tools was considered.

TABLE 3

| Test | Ballistic Protection | Rifle fired (Distance in feet) | Bullet Size | Did the bullet penetrate bucket and liner? | Did the bullet penetrate an adjacent wall or the opposite wall? |
|---|---|---|---|---|---|
| 23 | Yes | .308 (15) | 168 grain SMK | No | No |
| 24 | Yes | SKS (15) | 123 grain FMJ | No | No |

TABLE 3-continued

| Test | Ballistic Protection | Rifle fired (Distance in feet) | Bullet Size | Did the bullet penetrate bucket and liner? | Did the bullet penetrate an adjacent wall or the opposite wall? |
|---|---|---|---|---|---|
| 25 | Yes | AR15 .223 (15) | 55 grain FMJ | No | No |
| 26 | Yes | 12 gauge Slug(15) | 230 grain FMJ | No | No |

Example 4

The same aerial buckets as tested in Example 1 were then retrofitted with two layers of DYNEEMA™ panels between the aerial bucket and the liner to see if this would provide rifle threat protection. Each of the DYNEEMA™ panels were 7/32 in. (5.6 mm) thick and weighed 1 lb/ft$^2$(about 5 kg/m$^2$). The liner was removed so that the panels could be placed against the bucket. Two panels were placed on each sidewall and the floor of the bucket. The liner was then reinstalled over the panels to cover and enclose the panels. The panels added about 142 pounds of weight to the aerial lift device. If only a bottom panel was installed, about 18 pounds of weight was added to the aerial lift device. As shown in Table 4, protection was only provided against the 12 gauge ammunition fired at a distance of 15 feet. The other rifle ammunition penetrated the bucket and liner. However, the materials of tests 27-30 would have provided ballistic protection against the handguns as tested in Example 2.

TABLE 4

| Test | Ballistic Protection | Rifle fired (Distance in feet) | Bullet Size | Did the bullet penetrate bucket and liner? | Did the bullet penetrate an adjacent wall or the opposite wall? |
|---|---|---|---|---|---|
| 27 | Yes | .308 (15) | 168 grain SMK | Yes | Yes |
| 28 | Yes | SKS (15) | 123 grain FMJ | Yes | Yes |
| 29 | Yes | AR15 .223 (15) | 55 grain FMJ | Yes | Yes |
| 30 | Yes | 12 gauge Slug(15) | 230 grain FMJ | No | No |

Example 5

The aerial lift buckets of four aerial lift trucks were retrofitted with DYNEEMA™ panels between the aerial bucket and the liner as described in Example 2. The DYNEEMA™ panels were gel coated with a waterproofing agent before installation. After installation of the panels on the four sidewalls and the floor of the rectangular aerial lift baskets, the trucks were put back in service for about one year. The panels added about 71 pounds of weight to the aerial lift device. If only a bottom panel was installed, about 9 pounds of weight was added to the aerial lift device. The panels were then removed and the liner, aerial basket and panels were visually inspected for any sign of stress, degradation or other fatigue or damage as well as moisture or mold damage. The aerial buckets were also tested to ensure that the additional weight of the ballistic material did not cause any undue stress to the aerial bucket or to the boom or the vehicle. The aerial bucket arm was hydrostatically tested to ensure there was no evidence of stress or overuse of the buckets.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. An aerial lift system providing ballistic protection comprising:

an aerial lift device comprising a floor and a sidewall, the floor and the sidewall defining an interior cavity adapted for supporting one or more persons therein; and a liner comprising a floor and a sidewall and being adapted to be positioned within the interior cavity of the aerial lift device, and defining an opening between the aerial lift device and the liner; and a ballistic material adapted to be positioned in the opening between aerial lift device and the liner, the ballistic material providing at least an NIJ Type IIA level of protection.

2. The aerial lift system of claim 1, wherein the ballistic material provides at least an NIJ Type II level of protection.

3. The aerial lift system of claim 1, wherein the liner comprises a rim along the top of the sidewall of the liner, the rim being adapted to extend toward the aerial lift device to cover the opening between the aerial lift device and the liner.

4. The aerial lift system of claim 1, wherein the ballistic material is adapted to retrofit the aerial lift device and the liner.

5. The aerial lift system of claim 1, wherein the ballistic material is not visible from the exterior of the aerial lift device.

6. The aerial lift system of claim 1, wherein the aerial lift device is comprised of a ballistic material.

7. The aerial lift system of claim 1, wherein the liner is comprised of a ballistic material.

8. The aerial lift system of claim 1, wherein the ballistic material has a thickness of from about 4 to about 40 mm, a tensile strength to weight ratio of at least 2000 kN·m/kg, and a weight of less than 20 kg/m$^2$.

9. The aerial lift system of claim 1, wherein the ballistic material has a thickness of from about 5 to about 25 mm, a tensile strength to weight ratio of at least 2000 kN·m/kg, and a weight of less than 10 kg/m$^2$.

10. The aerial lift system of claim 1, wherein the ballistic material providing at least an NIJ Type IIIA level of protection.

11. The aerial lift system of claim 10, wherein the ballistic material has a thickness of about 5 to about 10 mm, a tensile strength to weight ratio of at least 2000 kN·m/kg, and a weight of about 5 to about 10 kg/m$^2$.

12. The aerial lift system of claim 11, wherein the ballistic material comprises a composite made from unidirectional fibers positioned between layers of resin; a woven fabric; ultra-high molecular weight polyethylene, fiberglass, an aromatic polyamide, an aromatic polyester, a thermoset liquid-crystalline polyoxazole, high modulus polypropylene, or nylon.

13. The aerial lift system of claim 1, wherein the ballistic material comprises a composite made from unidirectional fibers positioned between layers of resin.

14. The aerial lift system of claim 1, wherein the ballistic material comprises a woven fabric.

15. The aerial lift system of claim 1, wherein the ballistic material comprises ultra-high molecular weight polyethylene, fiberglass, an aromatic polyamide, an aromatic polyester, a thermoset liquid-crystalline polyoxazole, high modulus polypropylene, or nylon.

16. The aerial lift system of claim 1, wherein the ballistic material comprises ultra-high molecular weight polyethylene.

17. The aerial lift system of claim 1, wherein the ballistic material comprises a water-resistant gel coating on its exterior surface.

18. The aerial lift system of claim 1, wherein the aerial lift device comprises a work platform selected from the group consisting of a bucket, or a basket.

19. The aerial lift system of claim 1, wherein the work platform is adapted for being secured to an electric or hydraulic lift system of a lift vehicle.

20. The aerial lift system of claim 1, wherein the aerial lift device, the liner and the ballistic material are comprised of an electrical insulator.

* * * * *